United States Patent [19]

Schrader et al.

[11] 4,094,077

[45] June 13, 1978

[54] DRYER ARRANGEMENT

[75] Inventors: Alfons Schrader; Waldemar Schreiner; Anton Gessner, all of Remscheid-Lennep, Germany

[73] Assignee: Buttner-Schilde-Haas AG, Krefeld, Uerdingen, Germany

[21] Appl. No.: 729,143

[22] Filed: Oct. 4, 1976

[30] Foreign Application Priority Data

Oct. 4, 1975 Germany ..... 2544590

[51] Int. Cl.[2] ..... F26B 13/00

[52] U.S. Cl. ..... 34/155; 34/158

[58] Field of Search ..... 34/33, 155, 158

[56] References Cited

U.S. PATENT DOCUMENTS

| | | | |
|---|---|---|---|
| 1,569,558 | 1/1926 | Manson | 34/33 |
| 2,823,467 | 2/1958 | Minami | 34/155 |
| 3,060,594 | 10/1962 | Meier-Windhorst | 34/158 |

*Primary Examiner*—John J. Camby

*Attorney, Agent, or Firm*—Michael J. Striker

[57] ABSTRACT

Articles to be dried are conveyed through a tentering frame in a path. Air is heated and then directed into contact with the articles in direction transversely of the path. The air is directed by at least one crossflow blower unit and a plurality of channel elements, each of which has a foraminous wall which faces the articles passing through the frame. The blower is driven by a motor drive which is operative for circulating the heated air in direction through the blower unit and into the channel elements. Thereupon, the air passes through the respective foraminous walls to impinge against and thereby dry the articles. After impingement, the air is guided away from the articles by a plurality of air outlet passages which are respectively formed between adjacent ones of the channel elements which are successively arranged along the path at a predetermined spacing from each other. Each outlet passage has a relatively narrower cross-section closer to the path, and a relatively wider cross-section further from the path.

7 Claims, 3 Drawing Figures

DRYER ARRANGEMENT

BACKGROUND OF THE INVENTION

The present invention relates to dryer arrangements and, more particularly, to tenters having articles such as cloth which are to be dried.

Tenters are generally known in the art for drying and stretching cloth which is mounted on a frame. The cloth is mounted in taut condition with the aid of tenterhooks and conveyed by chain or roller drives or analogous transport devices through the frame. In order to achieve uniform drying of the textile material, the prior art has proposed various configurations in which the shape of the foraminous channel elements which are mounted adjacent to the advancing textile material is altered. Furthermore, the art has proposed using different types of air blower devices. Still further, the prior art has proposed using different arrangements for returning the flow of the drying air.

However, the prior art arrangements have proven unsatisfactory in providing uniform and even drying of the cloth. After impingement of the air against the textile material, a portion of the air will flow along the textile material in direction transversely of the path of travel of the textile material. This so-called transverse or cross flow results in excess air being present at the edges of the articles to be dried. Because more drying air contacts these edge portions, the drying of the articles does not proceed in a uniform manner.

SUMMARY OF THE INVENTION

Accordingly, it is the general object of the present invention to overcome the drawbacks of the prior art.

Another object of the present invention is to substantially eliminate the above-described cross flow effect.

An additional object of the present invention is to reliably and uniformly dry articles passing through a drying arrangement.

Still another object of the invention is to improve the efficiency of drying arrangements, as well as to provide a simple and inexpensive configuration for such arrangements.

In keeping with these objects and others which will become apparent hereafter, one feature of the invention, briefly stated, resides in conveying articles to be dried in a path through a frame. Air is directed towards the articles by a plurality of channel elements which are successively arranged along the path at a predetermined spacing from one another. Each element is operative for permitting air flowing through a respective element to impinge against the article in direction transversely of the path. After impingement, air is guided away from the articles by a plurality of air outlet passages which are respectively formed between each adjacent two channel elements. Each outlet passage leads away from the path and has a relatively narrower cross-section closer to the path and a relatively wider cross-section further from the path. Thus, articles passing through the arrangement are uniformly dried.

In accordance with the invention, the relatively narrower cross-section of each outlet passage is formed by mounting a cantilever arm on each of the channel elements. The arm extends across each of the passages in part and substantially reduces the cross flow effect. The air is guided, preferably in linear direction, away from the path and the channel elements for eventual recirculation through the arrangement.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF THE PREFERRED EMBODIMENTS

Figure 1:
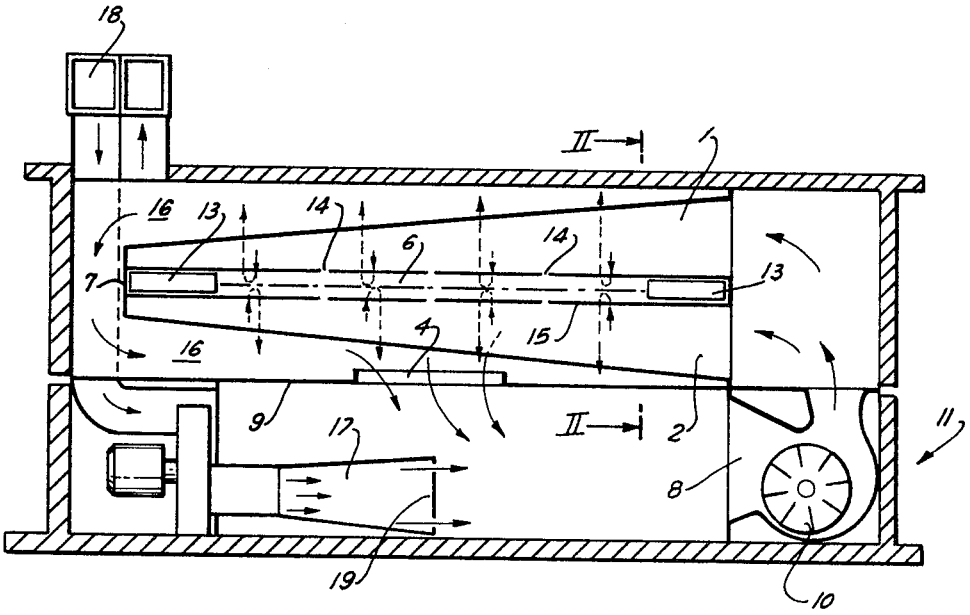
FIG. 1 is a side view of a preferred embodiment in accordance with the present invention.

Referring firstly to FIG. 1 of the drawing, it will be seen that reference numeral 11 generally identifies the housing or frame in which the articles are to be dried. The articles, diagrammatically represented by reference numeral 6, are conveyed in a path in direction of arrow 12 (FIGS. 2, 3) through a frame 11. The articles are supported in taut condition by support members 13. Support members 13 are movable by chain or roller drives or analogous transport means through the frame 11. Additional details of the support members 13 and the transport drive are not believed to be necessary since they are entirely conventional in the art and form no part of the present invention.

In accordance with the invention, air is directed against articles 6 for contact therewith. Thus, cross-flow blower means 10, which may comprise either a single blower unit or a plurality of such units coaxially arranged with respect to each other across the entire length of the housing, is operative for circulating air in the direction of the illustrated arrows into the interior of channel or nozzle elements 1, 2. The upper channel elements 1 are disposed above the path of travel for the articles, and the lower channel elements 2 are disposed beneath the path of travel.

Both upper and lower elements 1, 2 are successively arranged in direction along the path. Each element has a foraminous wall which faces the articles 6. Thus, the wall 14 of each upper element 1 faces the upper side of articles 6; and the wall 15 of each lower element 2 faces the lower side of the articles 6. In operation, the air flowing through the elements 1, 2 by virtue of the operation of the cross-flow blower means 10 exists through the foramina of walls 14, 15 and impinges in generally vertical direction against both sides of articles 6.

After impingement, the air is guided away from the articles 6 by a plurality of air outlet passages 3 which lead away from the path and which are respectively formed between each adjacent two of the elements 1 or 2. Each outlet passage 3 has a relatively narrower cross-section closer to the path, and a relatively wider cross-section located further from the path.

Figure 3:
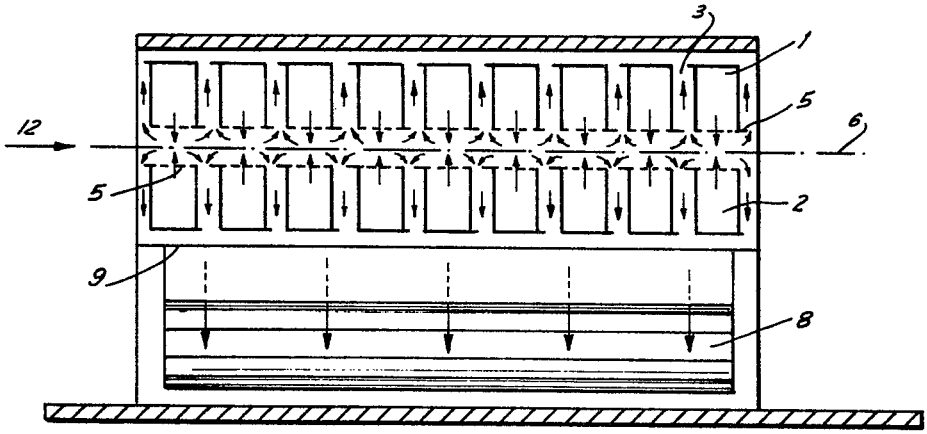
FIG. 3 is a longitudinal view of the embodiment of FIG. 1.

The upper row of channel elements 1, as shown in FIG. 3, is spaced at a distance from the lower row of channel elements 2. The intermediate space between the upper and lower rows is closed at the opposite longitudinal sides of the housing 11 by longitudinally-extending walls, such as closure walls 7. Thus, the drying air can only leave through the aforementioned passages 3 and be collected in an interior region 16. Air leaving from the lower row of elements 2 is directly conducted towards a discharge opening 4 which is elongated generally in direction along said path across the entire length of the housing 11. On the other hand, air leaving from the upper row of elements 1 flows around the elements 1, and is subsequently conducted towards the outlet 4 which is centrally formed in a partition wall 9.

Heater 17, preferably a gas burner or any analogous heating device, is located in a section of the frame 11 remote from a section 8 in which the blower 10 is mounted. This assembly assures easy access to the various component parts of the arrangement. Heater 17 utilizes fresh air from an intake 18 and is operative for discharging the heated combustion gases towards and past a baffle 19 in direction towards the blower 10 for recirculation through the arrangement.

Figure 2:
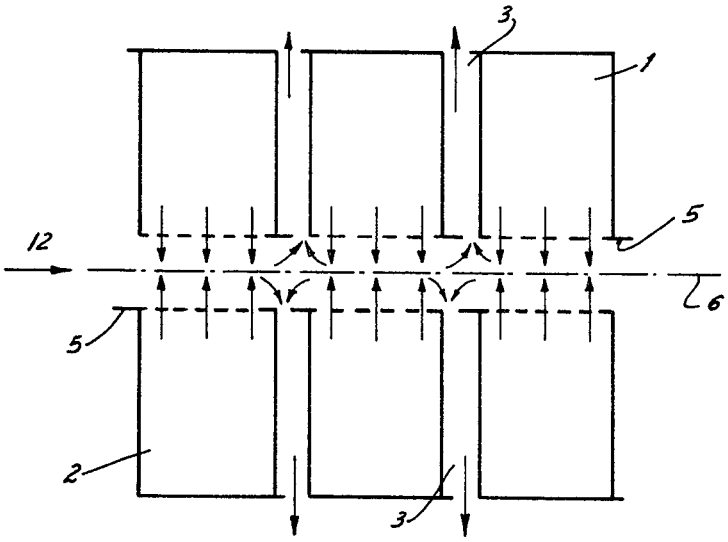
FIG. 2 is a diagrammatic, enlarged view of the section taken along line II—II.

The aforementioned narrow cross-section in the passage 3 is formed by mounting a cantilever arm 5 on each of the elements 1 or 2, so that the arm 5 extends in part across a respective passage. As shown in FIG. 2, the arms 5 are mounted at the lower region of the elements 1; and the arms 5 are mounted at the upper region of the elements 2. If desired, additional cantilever arms are mounted on the elements 1, 2 downstream of the first mentioned arms 5.

The arms 5 serve to accelerate the returning airflow after impingement with the articles 6. The arms 5 constrict the cross-section of a respective passage so as to achieve a venturi-type suction effect which draws the air directly into the passage.

The invention is not intended to be limited to the illustrated embodiment. For example, it is possible to provide several drying arrangements one above another.

It will be understood that each of the elements described above, or two or more together, may also find a useful application in other types of constructions differing from the types described above.

While the invention has been illustrated and described as embodied in a dryer arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for drying articles, particularly a tenter, comprising a housing having an interior; means subdividing said interior into two compartments, including a partitioning wall; means for conveying articles to be dried in an elongated path through one of said compartments; means for directing a plurality of streams of drying air against the articles, including a pair of discharging arrangements juxtaposed with one another across said path so as to bound a gap extending along said path from two opposite sides thereof and each including a plurality of channel elements successively arranged at a predetermined spacing from one another along, and each extending transversely of, said path, and having outlet ports facing said path, and means for feeding the drying air into said channel elements of said discharging arrangements for the drying air to emerge through said outlet ports of said channel elements and impinge against the articles from both of said two sides; and means for guiding the flow of the drying air away from the articles after the impingement thereagainst, including at least one side wall extending longitudinally of said path between said discharging arrangements to close said gap at least at one transverse side thereof, a plurality of air outlet passages formed between each adjacent two of said channel elements and each having a main portion of a predetermined flow-through cross-sectional area and an inlet port open into said gap, means for partially obstructing each of said outlet passages at said inlet port thereof, and an elongated discharge outlet extending longitudinally of said path and centrally through said partitioning wall and communicating with said outlet passages of said discharging arrangements and with the other compartment of said housing.

2. The apparatus of claim 1; wherein said obstructing means includes a cantilever arm extending in part across each of said passages.

3. The apparatus of claim 2; and further comprising additional cantilever arms extending in part across each of said passages at a spaced distance further from said path.

4. The apparatus of claim 2, wherein first and second ones of said channel elements are respectively located at opposite sides of said path; and further comprising means for mounting said arms on said first and second channel elements respectively so that said arms face each other and are located on opposite sides of said path.

5. The apparatus as defined in claim 4, wherein said arms of said discharging arrangements which are located opposite one another across said path are offset with respect to one another longitudinally of said path.

6. The apparatus of claim 1, wherein each of said channel elements has a wedge-shaped cross-section.

7. The apparatus of claim 1, wherein each of said channel elements has a foraminous wall at said outlet ports which faces the articles passing through the arrangement.

* * * * *